US007429023B2

(12) United States Patent
Morrow

(10) Patent No.: US 7,429,023 B2
(45) Date of Patent: Sep. 30, 2008

(54) DECK SUPPORT

(76) Inventor: Michael L. Morrow, 26611 Clarksburg Rd., Damascus, MD (US) 20872

( * ) Notice: Subject to any disclaimer, the term of this patent is extended or adjusted under 35 U.S.C. 154(b) by 33 days.

(21) Appl. No.: 11/540,888

(22) Filed: Sep. 29, 2006

(65) Prior Publication Data

US 2008/0078894 A1 Apr. 3, 2008

(51) Int. Cl.
*A47F 5/00* (2006.01)

(52) U.S. Cl. ..... 248/300; 248/200; 248/316.1; 52/715; 52/712; D8/354

(58) Field of Classification Search ..... 248/300, 248/27.1, 316.1, 309.1, 313, 154, 220.1, 248/200, 65, 339, 317, 223.1; D8/354, 349, D8/373; 52/715, 712, 243, 696, 655.1, 731.3
See application file for complete search history.

(56) References Cited

U.S. PATENT DOCUMENTS

| | | | | | |
|---|---|---|---|---|---|
| 2,679,911 | A | | 6/1954 | Bhend | |
| 2,687,864 | A | * | 8/1954 | Kohler | 248/74.4 |
| 3,280,527 | A | | 10/1966 | Faust | |
| 3,718,307 | A | | 2/1973 | Albanese | |
| D237,460 | S | * | 11/1975 | Bordman | D8/373 |
| 4,163,372 | A | * | 8/1979 | Frye et al. | 62/259.1 |
| D257,219 | S | * | 10/1980 | Cook | D8/354 |
| 4,248,398 | A | * | 2/1981 | Doyel | 248/220.1 |
| D264,423 | S | * | 5/1982 | Naylor | D8/1 |
| D310,520 | S | * | 9/1990 | Bedard | D14/432 |
| 5,060,891 | A | * | 10/1991 | Nagy et al. | 248/56 |
| 5,240,216 | A | * | 8/1993 | Lin et al. | 248/300 |
| 5,366,194 | A | * | 11/1994 | Finney | 248/218.4 |
| 5,810,303 | A | * | 9/1998 | Bourassa et al. | 248/205.1 |
| 5,897,086 | A | * | 4/1999 | Condon | 248/220.1 |
| D431,999 | S | * | 10/2000 | Haltof | D8/354 |
| D434,639 | S | * | 12/2000 | Willett | D8/354 |
| D442,471 | S | * | 5/2001 | Willett | D8/354 |
| 6,462,961 | B1 | * | 10/2002 | Johnson et al. | 361/825 |
| 6,669,156 | B2 | * | 12/2003 | East et al. | 248/300 |
| D503,330 | S | * | 3/2005 | Murphy et al. | D8/354 |
| D520,344 | S | * | 5/2006 | Vejmarker | D8/354 |
| 7,053,300 | B2 | * | 5/2006 | Denier et al. | 174/58 |
| 7,172,221 | B1 | * | 2/2007 | Ferrara | 285/61 |
| D563,770 | S | * | 3/2008 | Payne, Jr. | D8/354 |
| 2002/0047073 | A1 | * | 4/2002 | Deciry et al. | 248/49 |
| 2007/0199274 | A1 | * | 8/2007 | Rice | 52/712 |
| 2007/0210021 | A1 | * | 9/2007 | Whitehead et al. | 211/70.6 |

* cited by examiner

*Primary Examiner*—Kimberly Wood
(74) *Attorney, Agent, or Firm*—Raymond M. Galasso; Galasso & Assoc. LP

(57) ABSTRACT

Deck Support is an L-shaped bracket with a plurality of holes and a slot for fastening it to a house joist and the deck band board. Ideally, a user secures the first side of the L-shaped bracket to the house joist using nails and/or bolts through the plurality of holes and attaches the second side of the L-shaped bracket to the inside band of the house and band board of the deck utilizing a carriage bolt.

1 Claim, 1 Drawing Sheet

DECK SUPPORT

CROSS REFERENCE TO RELATED APPLICATIONS

This Non-Provisional United States Patent Application does not claim priority to any United States Provisional Patent Applications or any foreign patent applications.

FIELD OF THE DISCLOSURE

The disclosures made herein relate generally to the new construction and home improvement industry. The invention discussed herein is in the general classification of deck attachment and safety devices.

BACKGROUND

Many individuals purchase homes with decks to enjoy the outdoors or host barbeques or other outdoor parties. Decks also enhance the amount of living space of a home. Often, a homeowner chooses to add a deck to a house after purchasing the house if one does not already exist.

Building a deck can be a difficult aspect of construction without the services of an accomplished carpenter. Even decks that are constructed by professionals can collapse for a variety of reasons. Deck collapses can kill or seriously injure persons on or under the deck. Traditionally, decks are attached to a house by using the house band board and the deck band board. The house band board does not provide adequate support in many cases for attaching the deck band board. The two band boards can peel away from one another causing deck instability or a potential collapse.

Hence, there is a need in the art for a convenient, inexpensive and effective device for attaching the deck band board to the house joists.

SUMMARY OF THE DISCLOSURE

Deck Support is a L-shaped bracket with a slot and a plurality of holes for fastening to a band board of a deck and the joist of a house.

The principal object of this invention is to provide a device that can safely secure a deck to a house.

Another object of this invention is to provide a device that can be easily installed by skilled craftsmen or layman.

Another object of this invention is to provide an affordable device for connecting the band board of a deck to the joist of a house.

Yet another object of this invention is to provide a device that can be retrofitted to existing decks.

DETAILED DESCRIPTION OF THE DRAWINGS

The preferred embodiment of Deck Support is comprised of at least some of the following: a metal L-shaped bracket with a plurality of holes and a slot for fastening it to the house joist and deck band board.

Figure 1:
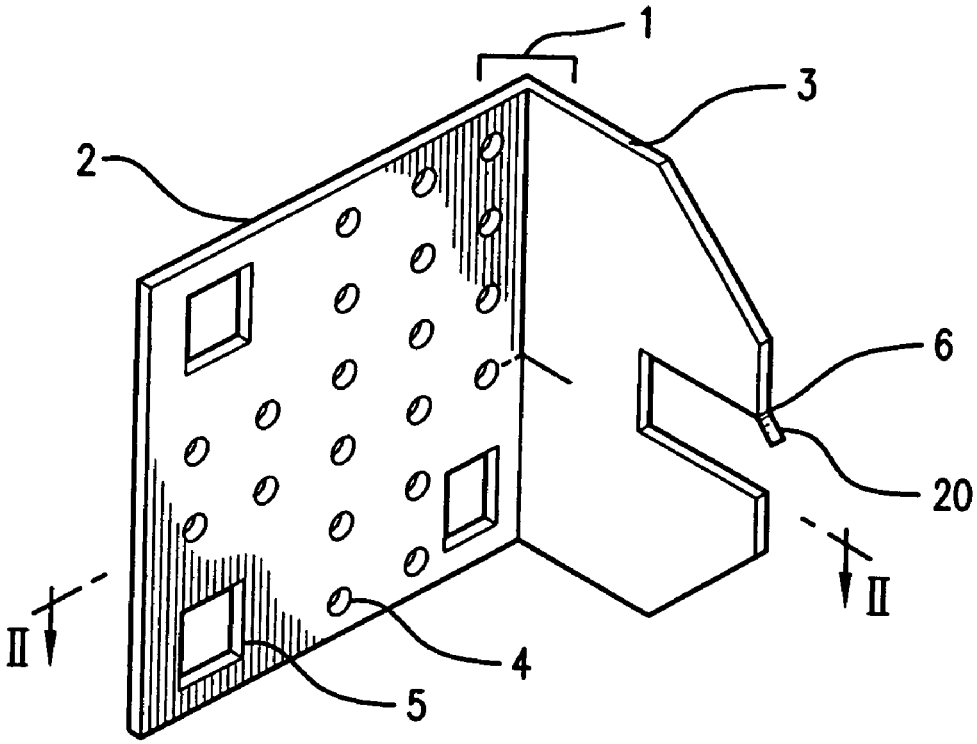
FIG. 1 depicts a perspective view of the preferred embodiment of the present invention.

FIG. 1 shows the preferred embodiment of the invention. An L-shaped bracket 1 has a first side 2 that is five inches long and five inches wide and a second side 3 that is five inches long and three inches wide at its widest part.

The first side 2 is approximately rectangular while the second side 3 tapers from the top and bottom and has a slot 6 in approximately the center. The slot 6 is approximately nine-sixteenths (9/16) of an inch wide and an inch and a half deep. A tab 20 is located on the top of the slot 6. A plurality of holes 4 is spaced evenly throughout the first side 2. Three square holes 5 with nine-sixteenths of an inch sides are located on the perimeter of the first side 2.

The plurality of holes 4 on the first side 2 is designed to permit nails to pass through the first side 2. The square holes 5 on the first side 2 are for insertion of carriage bolts and nuts for increased stability. The first side 2 and the second side 3 are made of metal, preferably steel for durability and strength.

Figure 2:
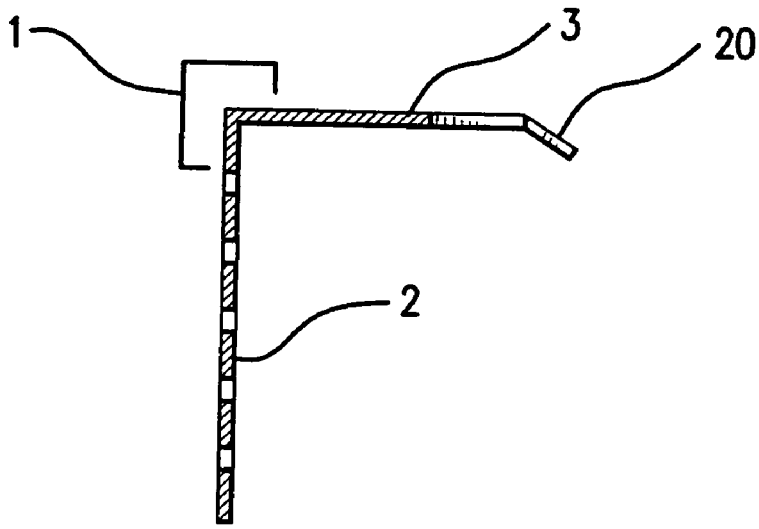
FIG. 2 depicts a cross-sectional view of the preferred embodiment of the invention cut along the line II-II of FIG. 1.

FIG. 2 depicts a cross-sectional view of the preferred embodiment of the invention. The thickness of the first side 2 and second side 3 can be seen in greater detail. Ideally, the first side 2 and the second side 3 are one-eighth of an inch thick though a variety of sizes could be utilized. The tab 20 located above the slot 6 is also clearly visible. The tab 20 is rotated inward at a twenty degree angle from the second side 3.

To use Deck Support, a user would secure the first side of the L-shaped bracket to the house joist using nails in the plurality of holes. The second side of the L-shaped bracket would be utilized to attach tightly the inside band of the house to the band board of the deck using the slot and a carriage bolt.

Alternatively, if blocking (additional supports to prevent joists from twisting during loading) is being used for TGI's and truss floor joists, the first side of the L-shaped bracket is attached to the house joist with carriage bolts through the square holes instead of nails through the plurality of holes.

A variety of other methods for utilizing the present invention to secure decks to homes also may be possible. In addition, the present invention may be utilized for a variety of other home or business improvement projects.

The materials utilized for Deck Support may vary widely but will likely include metal as its major component. The metals would ideally be selected from available steel or alloys of steel and aluminum. The production process related to the use of these metals insures that the metal is non-corrosive, durable and strong. The selected metal should have high impact strength and be capable of accepting and retaining coloring materials for an extended length of time.

It should be obvious that the components of the present invention can be of various shapes and sizes. It should also be obvious that the components of the invention can be made of different types of metals or other suitable materials and can be of any color.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An L-shaped bracket comprising:

(a) a first side made of steel that is approximately rectangular with a plurality of holes spaced approximately evenly throughout and a first square hole located in the upper outer corner, a second square hole located in the lower outer corner and a third square hole located in the lower inner corner;

(b) a second side that is made of steel and is tapered from the top and bottom toward the center where a slot is located;

(c) a tab located above the slot extending at a twenty degree angle inward from the second side;

(d) said first side is approximately five inches long and five inches wide and said second side is approximately five inches long and three inches wide; and (e) said slot is approximately nine-sixteenths of an inch wide.

* * * * *